US005396577A

United States Patent [19]

Oikawa et al.

[11] Patent Number: 5,396,577

[45] Date of Patent: Mar. 7, 1995

[54] SPEECH SYNTHESIS APPARATUS FOR RAPID SPEED READING

[75] Inventors: Yoshiaki Oikawa; Kenzo Akagiri, both of Kanagawa, Japan

[73] Assignee: Sony Corporation, Tokyo, Japan

[21] Appl. No.: 994,113

[22] Filed: Dec. 22, 1992

[30] Foreign Application Priority Data

Dec. 30, 1991 [JP] Japan ..... 3-360688

[51] Int. Cl.[6] ..... G10L 5/00

[52] U.S. Cl. ..... 395/2.69

[58] Field of Search ..... 381/51-53; 395/2.67-2.78

[56] References Cited

U.S. PATENT DOCUMENTS 4,692,941 9/1987 Jacks et al. ..... 381/52
4,749,353 6/1988 Breedlove ..... 434/169
4,852,168 7/1989 Sprague ..... 381/52
5,189,702 2/1993 Sakurai et al. ..... 381/51
5,204,905 4/1993 Mitome ..... 381/52

*Primary Examiner*—David D. Knepper
*Attorney, Agent, or Firm*—Limbach & Limbach
Philip M. Shaw, Jr.

[57] ABSTRACT

In a speech synthesizing apparatus, importance degree information indicative of a degree of importance with respect to each text portion of input original text data is added to this text portion. Then, the original text data with such importance degree information is input. When a rapid reading process, or a head searching process is carried out for the original text input, speech synthesis is carried out by controlling several stages which text portion should be skipped, or at which speed, the text portions should be synthesized, in response to a speed instruction and importance degree information which are being input into the speech synthesizing apparatus.

4 Claims, 3 Drawing Sheets

SPEECH SYNTHESIS APPARATUS FOR RAPID SPEED READING

BACKGROUND OF THE INVENTION

1. Field of the Invention

The present invention generally relates to a speech synthesizing apparatus, and more specifically, to such a speech synthesizing apparatus capable of synthesizing speech from text.

2. Description of the Prior Art

As shown in FIG. 1, a speech synthesizing apparatus 1 performed by the rule synthesizing system has been proposed as the conventional speech synthesizing system for synthesizing text containing sentences mixed with Katakana characters and Kanji characters, as described in Japanese Laid-open Patent Application No. Hei-5-94196 in 1994.

In this speech synthesizing apparatus 1, a series of characters inputted from a text input function block 2A of a sentence analyzing unit 2 is analyzed with reference to a dictionary function block 2C in a text analyzing function block 28, and Japanese syllabary, word, phrase boundary and also basic accent are detected in a detection function block 2D. The detection result of the sentence analyzing unit 2 is arranged as a series of phoneme symbols 3B in accordance with a predetermined phoneme rule in a phoneme rule block 3A of a speech synthesizing rule unit 3, and then supplied to a phoneme control parameter generating block 3C. Similarly, the detection result is arranged as a series of phrase, accent and pauses 3 E in accordance with a predetermined rhythm rule in a rhythm rule block 3D, and thereafter is given to a rhythm control parameter generating block 3F.

In the phoneme control parameter generating block 3C and the rhythm control parameter generating block 3F, a speech reading speed is designated by a speed instruction issued from a speed instruction generating unit 4, and then a synthesizing parameter 3G having this speech reading speed and a basic pitch pattern 3H having this speech reading speed are produced. These synthesizing parameter 3G and basic pitch pattern 3H are supplied to a speech synthesizing filter block 5A of a speech synthesizing unit 5.

Thus, a speech synthesizing filter block 5A produces a synthesized speech output 5B, resulting in the final as an output of the speech synthesizing apparatus 1.

In such a conventional speech synthesizing apparatus 1, when either rapid (speed) reading, or head searching is carried out, the speed instruction of the speed instruction generating unit 4 provided outside this speech synthesizing apparatus 1 is varied by means of a software parameter, or a hardware member such as a variable resistor, so that the generation speeds of the synthesizing parameter 3G and the basic pitch pattern 3H in the phoneme control parameter generating block 3C and the rhythm control parameter generating block 3F are controllable.

However, the above-described conventional speech synthesizing method, is problematic. When the rapid reading is performed by increasing the reading speed of the text, this reading speed cannot be increased higher than a speed corresponding to the limit values of the signal processing speeds with respect to the sentence analyzing unit 2, the speech synthesizing rule unit 3 and the speech synthesizing unit 5. Moreover, a lengthy searching time is required.

Also, to perform head searching, the information required for the search, (e.g., indexes of phrases) which has been previously prepared for text inputted into the text input block 2A, must be input. As a result, a very cumbersome process is needed outside the speech synthesizing apparatus 1. This presents another problem that a large-scaled speech synthesizing system must address.

SUMMARY OF THE INVENTION

The present invention has been made in an attempt to solve the above-described various problems of the conventional speech synthesizing system, and therefore, has an object to provide such a speech synthesizing apparatus capable of performing a rapid reading process and a search process at a higher speed than that of the conventional speech synthesizing system, without increasing the overall system scale.

To achieve the above-described object, the speech synthesizing apparatus 11 of the present invention, records input text data TX, which contains both input text data and information which describes the degree of importance with respect to each text portions.

The speech synthesis process is carried out by skipping the text portions TX1, TX2, - - - , having a low degree of importance based upon the importance degree information previously recorded.

Furthermore, the above-described speech synthesis apparatus 11 includes an input means 13 for designating synthesizing speed information 12G, which allows having a low degree of importance to be skipped during the speech synthesis process.

In accordance with the present invention, since the importance degree information IP1, IP2, - - - , has been added to the respective text portions TX1, TX2 of the text data TX, the respective text portions TX1, TX2, - - - , of the relevant text data TX are categorized by levels indicative of the degrees of importance related to the relevant text portions TX1, TX2, - - - . This is required to facilitate the rapid reading process and the search process. As a consequence, one level of the multiple levels is designated in accordance with the speeds of the rapid reading process and of the search process, so that only such text portions TX1, TX2, - - - , having the same degree of importance may be disconnected and synthesized with each other while skipping nonsimilar text portions. Therefore, the rapid reading speed and the search speed of the present invention can be further increased, as compared with those of the conventional speech synthesizing system.

BRIEF DESCRIPTION OF THE DRAWINGS

For a better understanding of the present invention, reference is made to the detailed description in conjunction with the accompanying drawings, in which.

DETAILED DESCRIPTION OF THE PREFERRED EMBODIMENTS

Referring now to drawings, a speech synthesizing apparatus according to a preferred embodiment of the present invention will be described.

Figure 1:
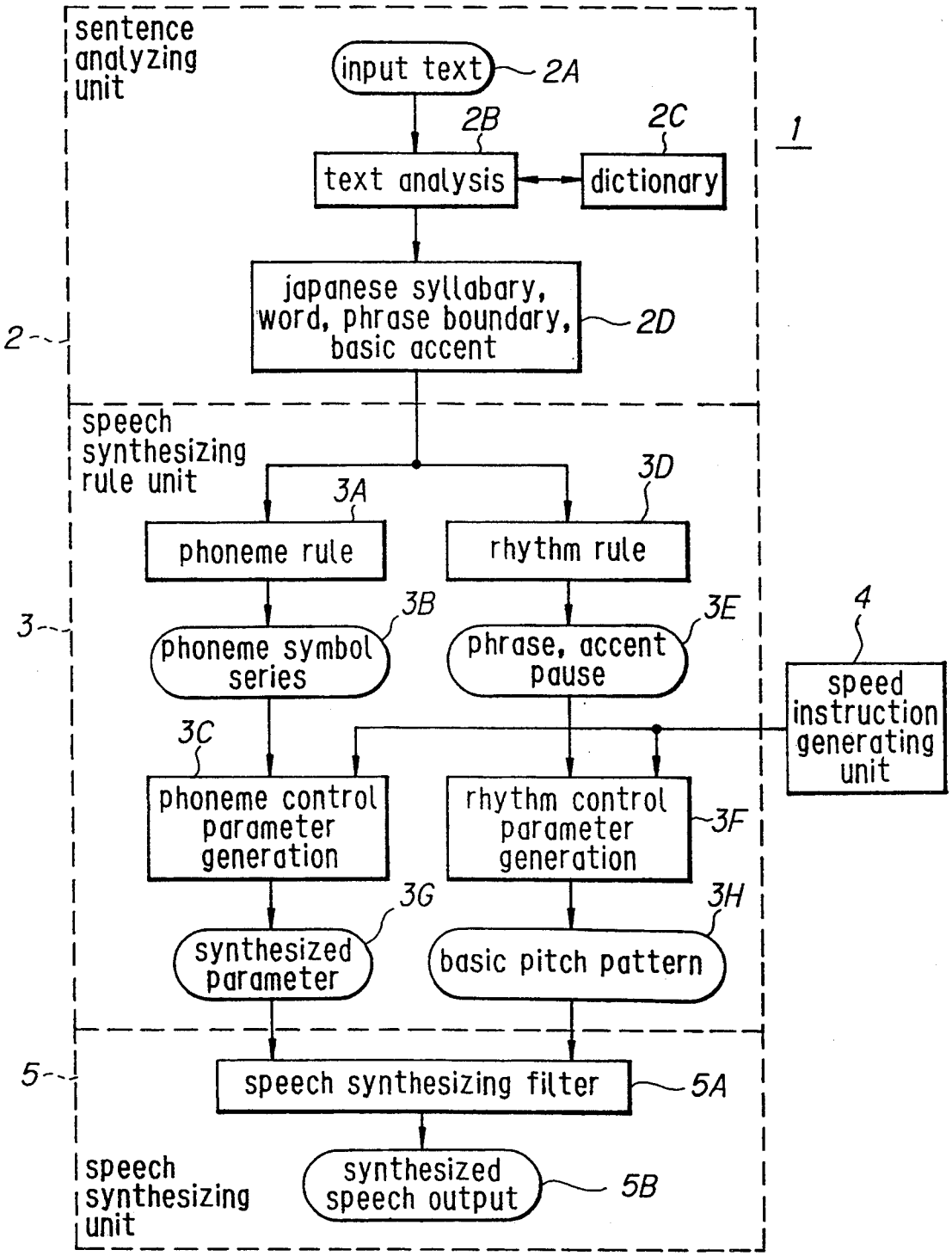
Fig. 1 PRIOR ART
FIG. 1 schematically represents a functional block diagram of the conventional speech synthesizing apparatus.
Figure 2:
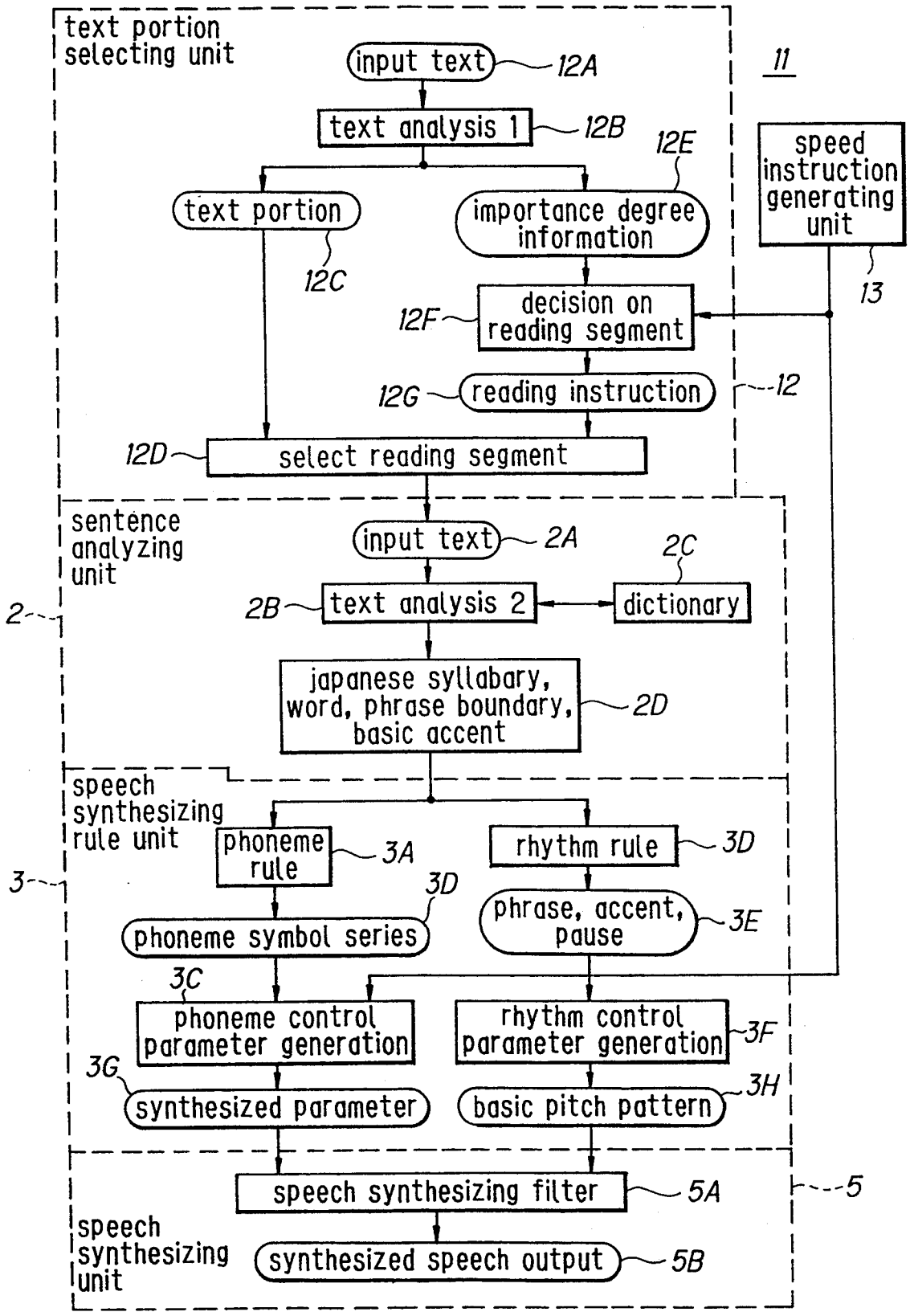
FIG. 2 schematically shows a functional block diagram of a speech synthesizing apparatus according to a preferred embodiment of the present invention.

In FIG. 2, reference numeral 11 denotes an overall arrangement of the speech synthesizing apparatus according to the preferred embodiment of the present invention. In this drawing, like reference numerals represent identical or similar components of FIG. 1. Similar to the arrangement of FIG. 1, this speech synthesizing apparatus comprises a sentence analyzing unit 2, a speech synthesizing rule unit 3, and a speech synthesizing unit 5.

Figures 3A, 3B, 3C, 3D, 3E:
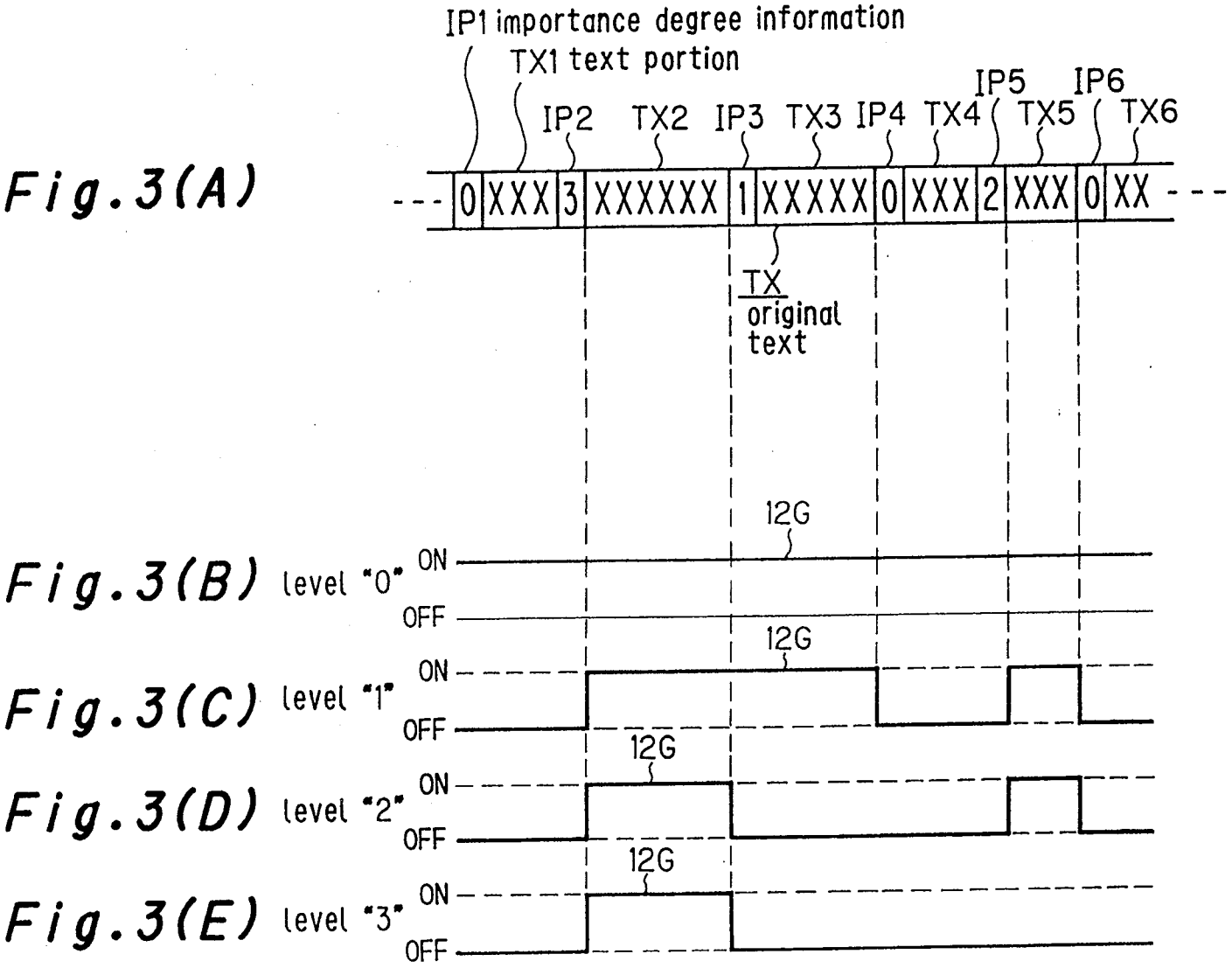
FIG. 3(A) through 3(E) show signal waveform charts for presenting original text data and a structure of a reading instruction.

In the speech synthesizing apparatus 11 shown in FIG. 2, a text portion selecting unit 12 is provided at a prestage of the sentence analyzing unit 2, and a speed instruction generating unit 13 is externally employed. Then, as shown in FIG. 3A, a text portion corresponding to a skip level designated by a reading speed instruction is designated based upon degrees of importance for the text portions TX1, TX2, - - - , with employment of importance degree information IP1, IP2, - - - . The importance degree information has been inserted as information used to a head search, into head portions of the text portions TX1, TX2, - - - , of the input original text data TX. Accordingly, the process for designating the reading speed is executed.

It should be noted that the inserted importance degree information represent levels with respect to the degrees of importance about the subsequent text portions TX1, TX2, - - - , depending upon the contents thereof. For instance, the higher the values the higher the level of importance degrees becomes.

The text portion selecting unit 12 enters an input text-12A constructed of the original text data TX (see FIG. 3A) into a text analyzing block 12B. The text analyzing block 12B separates the original text data TX into the text portions TX1, TX2, - - - , and also the importance degree information IP1, IP2, - - - . The separated text portions 12C (i.e., symbols TX1, TX2, - - - , of FIG. 3A) are input into a reading segment selecting block 12D. On the other hand, the importance degree information 12E (namely, symbols IP1, IP2, - - - of FIG. 3A) is input into a reading segment determining block 12F, so that a determining process of a reading segment is executed at a speed defined by the speed instruction given from the speed instruction generating unit 13.

As a consequence, a reading instruction 12G produced by the reading segment determining block 12F contains instructions as shown in Table 1. That is, the text portions are eventually selected in the disconnected form, and simultaneously the text portions which are not read are skipped by selecting only the reading sections designated among the text portions TX1, TX2, - - - .

TABLE 1

| Reading Instruction 12G | Reading speed | Skipping level |
|---|---|---|
| 00 | normal speed | level 0 |
| 01 | normal speed | level 1 |
| 02 | normal speed | level 2 |
| 03 | normal speed | level 3 |
| 10 | rapid reading 1 | level 0 |
| 11 | rapid reading 1 | level 1 |
| 12 | rapid reading 1 | level 2 |
| 13 | rapid reading 1 | level 3 |
| 20 | rapid reading 2 | level 0 |
| 21 | rapid reading 2 | level 1 |
| 22 | rapid reading 2 | level 2 |
| 21 | rapid reading 2 | level 3 |

This reading instruction 12G is given to the reading segment selecting block 12D.

In this preferred embodiment, the skip levels "0," "1," and "2" defined in Table 1 are preset as follows: At the skip level "0", as shown in FIG. 3B, all of the text portions having the values of the importance degree information of "0," "1" and "2" are read. At the skip level "1," as indicated in FIG. 3C, the text portions having the values of the importance degree information greater than "0" (namely, exclude the value of 0 are read. Further, at the skip level 2, as represented in FIG. 3D, the text portions with the values of the importance degree information larger than "1" (namely, exclude the values of "0" and "1") are read. Finally, as indicated in FIG. 3E, when the skip level becomes "3," the text portions with the values of the importance degree information greater than "2" (namely, exclude the values of "0," "1," "2") are read.

There are prepared three different sorts of the reading speeds, i e. "normal speed," "rapid speed 1," and "rapid speed 2."

The reading segment selecting block 12D selects the text portions TX1, TX2, to be read based on the reading instruction 12G and outputs the selected text portion to the sentence analyzing unit 2.

In the speech synthesizing apparatus 11 with the above-described arrangement, as illustrated in FIG. 3A, the original text data TX used in the input text block 12A previously contains the importance degree information IP1, IP2, - - - , indicative of the importance degree (for example, the importance degree as the keyword) with respect to a series of text portions TX1, TX2, - - - . Then, the importance degree information IP1, IP2, - - - , 12E is separated from the text portion 12C by executing the process of the text analysis block 12B.

As a result, a series of importance degree information IP1, IP2, - - - which has been extracted, or separated from the original text data, is processed by the extracting process in the reading segment determining block 12F based on the skip levels indicated by the speed instructions issued from the speed instruction generating unit 13. Thus, the reading instruction 12G to designate the text portion to be read is produced by utilizing the extracted result.

Accordingly, the following selecting process is executed by the reading segment selecting block 12D. That is, as represented in FIGS. 3A to 3E, in accordance with the contents of the speed instruction issued from the speed instruction generating unit 13, when the skip level "0" is designated, all of the text portions are read. Similarly, when the skip level 1 is designated, the text portions with the importance degree information greater than 1 are read; when the skip level 2 is designated, the text portions with the importance degree information greater than 2 are read; and when the skip level 3 is designated, the text portions with the importance degree information greater than 3 are read. As a consequence, a series of text portions which have been selected in accordance with the skip levels are supplied to the text input block 2A of the sentence analyzing unit 2.

The sentence analyzing unit 2 analyzes the selected text portions to detect the words, boundaries of phrases, and basic accents in a similar manner to that of FIG. 1, on the basis of the dictionary (FIG. 2D).

The detection results of the words, boundaries of phrases, and basic accents are processed in accordance with a predetermined phoneme rule in the speech synthesizing rule unit 3, and then a synthesized parameter indicating when the text to be read under no intonation is produced. At this time, lengths of time for the respective phoneme are controlled in accordance with the speeds of the speed instructions so as to be coincident with the "normal reading" the "rapid reading 1" and the "rapid reading 2".

Furthermore, the detection results of the words, the boundaries of phrases, and the basic accents are processed in the speech synthesizing rule unit 3 in accordance with a predetermined phoneme rule in a similar manner to those of FIG. 1, so that a basic pitch pattern indicative of the intonation of the overall text input is produced in accordance with the speeds of the speed instructions.

Thus, the resulting basic pitch pattern and synthesis parameter are used in the process for generating voice in the speech synthesizing unit 5 in a similar way to that shown in FIG. 1.

With the above-described arrangement, according to the speech synthesizing apparatus 11, synthesized speech can be outputted when the input text is rapidly read, or read under skip condition in conformity to the speed instruction designated by the importance degree information contained in the input text.

Therefore, according to the speech synthesizing apparatus of the above-described arrangement, there are specific advantages when text to which the importance degree information has been added is speech-synthesized during rapid reading. For instance, in text which has been recorded on a medium, the structure of the original text data to be inputted (namely, a series of symbol containing information about words, boundaries of phrase, reading and basic accents), obtained by and analyzed in a sentence analyzing apparatus has been previously known. In this case, since several stages of the search levels can be set first, the capability to perform a search operation is increased. Secondly, since the head searching information, i.e., the importance degree information codes are contained in the input text, there is another advantage that no care is taken to consider the head searching operation at the system side.

It should be noted that the structure of the input text containing the sentences mixed with the Katakana and Kanji characters has been described as the structure of the original text data in the above-described embodiment of the present invention, but the principles disclosed apply to the characters of any language. Also, there is a similar advantage that the importance degree information has been added to the symbol series involving the words, boundaries of phrases, reading and basic accent information, which have been obtained by analyzing the input text by the sentence analyzing apparatus. In this case, the sentence analyzing unit 2 is no longer required.

As previously described in detail, in accordance with the present invention, such a speech synthesizing apparatus for synthesizing speech from the input text can be readily realized, which processes and enters text after the importance degree information, indicative of the importance degree for the text portions, has been added thereto. When either the rapid reading process, or the head searching process is carried out, the speech can be synthesized while controls at several stages determine which text portions are skipped, or at which speed, the text portions are synthesized based on the speed instruction and the importance degree information.

What is claimed is:

1. A speech synthesizing apparatus for recording text input data comprising:

recorded text input data containing a recorded importance degree information indicator and a text portion, wherein said recorded importance degree information indicator reflects the level at which the corresponding text portion can be skipped, means for synthesizing speech based on the recorded text input data, wherein text portions are selected according to the recorded importance degree information indicator, and input means for designating synthesizing speed information, wherein the speech is synthesized by skipping the text portion having the low importance degree based on said synthesizing speed information and said recorded importance degree information indicator during speech synthesis.

2. A speech synthesizing apparatus, comprising:

recorded input text data containing a recorded importance degree information indicator and a text portion, wherein said recorded importance degree information indicator reflects the level at which the corresponding text portion can be skipped, text portion selecting means for separating the input text data into text portions and associated importance degree information to select a reading segment of said text data according to said importance degree information, sentence analyzing means which receives an output signal from said text portion selecting means, said sentence analyzing means including a text analysis section for analyzing a series of input characters into at least words and basic accents with reference to a dictionary to output a signal representative of said words and said basic accents, speech synthesizing rule means which receives an output signal from said sentence analyzing means, said speech synthesizing rule means including a phoneme rule block, a phoneme symbol series block for forming a series of phoneme symbols according to a phoneme rule and a synthesizing speed instruction, and for supplying said series of phoneme symbols to a phoneme control parameter generating block to form a synthesizing parameter, and a rhythm rule block, which generates a series of phrases, accents and pauses according to a rhythm rule and an input from said sentence analyzing means and outputs the series to a rhythm control parameter generating block to form a basic pitch pattern, speech synthesizing means including a speech synthesizing filter for outputting a synthesized speech according to said synthesizing parameter and said basic pitch pattern; and speed instruction generating means for altering a reading segment according to said recorded importance degree information and for outputting a speed instruction which specifies a synthesizing speed to said phoneme control parameter generating block and said rhythm control parameter generating block.

3. A speech synthesizing apparatus, comprising:

recorded input text data containing a recorded importance degree information indicator and a text portion, wherein the recorded importance degree information indicator reflects the level at which the corresponding text portion can be skipped, text portion selecting means for separating the input text data into text portions and associated importance degree information to select a reading segment of the text data according to the importance degree information, sentence analyzing means which receives an output signal from the text portion selecting means, the sentence analyzing means including a text analysis section for analyzing a series of input characters into at least words and basic accents with reference to a dictionary to output a signal representative of the words and the basic accents, speech synthesizing rule means which receives an output signal from the sentence analyzing means, the speech synthesizing rule means including a phoneme rule block, a phoneme symbol series block for forming a series of phoneme symbols according to a phoneme rule and a synthesizing speed instruction, and for supplying the series of phoneme symbols to a phoneme control parameter generating block to form a synthesizing parameter, and a rhythm rule block, which generates a series of phrases, accents and pauses according to a rhythm rule and an input from the sentence analyzing means and outputs the series to a rhythm control parameter generating block to form a basic pitch pattern, speech synthesizing means including a speech synthesizing filter for outputting a synthesized speech according to the synthesizing parameter and the basic pitch pattern, speed instruction generating means for altering a reading segment according to the recorded importance degree information and for outputting a speed instruction which specifies a synthesizing speed to the phoneme control parameter generating block and the rhythm control parameter generating block, and wherein the input text data contains one recorded importance degree information corresponding to each of the text portions, and the recorded importance degree information includes a code representative of the level at which the associated text portion may be skipped for the purposes of rapid reading or searching.

4. A speech synthesizing apparatus as claimed in claim 3, wherein said code comprises codes at two different values, and said speech synthesizing means skips one or more of said text portions to which a same code is added according to said synthesizing speed to synthesize speech.

* * * * *